US007360270B2

(12) United States Patent
Moskovich et al.

(10) Patent No.: US 7,360,270 B2
(45) Date of Patent: Apr. 22, 2008

(54) TOOTHBRUSH

(75) Inventors: Robert Moskovich, East Brunswick, NJ (US); Tanja Langgner, London (GB); Joachim Storz, Zell am See (AT); Thomas Küchler, Schliem (AT)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 11/053,583

(22) Filed: Feb. 8, 2005

(65) Prior Publication Data

US 2005/0188487 A1 Sep. 1, 2005

Related U.S. Application Data

(63) Continuation of application No. PCT/US03/24878, filed on Aug. 8, 2003.

(60) Provisional application No. 60/402,162, filed on Aug. 9, 2002.

(51) Int. Cl.
*A61C 17/16* (2006.01)
*A46B 13/00* (2006.01)
*A46B 9/04* (2006.01)

(52) U.S. Cl. ..... 15/28; 15/167.1; 15/22.1

(58) Field of Classification Search ..... 15/167.1, 15/201, 22.1, 22.2, 28, 110
See application file for complete search history.

(56) References Cited

U.S. PATENT DOCUMENTS

| | | | | |
|---|---|---|---|---|
| 301,644 | A | | 7/1884 | Thompson |
| 1,058,273 | A | | 4/1913 | Thompson |
| 1,616,484 | A | | 2/1927 | Beynon |
| 1,688,581 | A | | 10/1928 | Glassman |
| 1,924,152 | A | | 8/1933 | Coney et al. |
| 2,003,243 | A | | 5/1935 | Campbell et al. |
| 2,111,880 | A | | 3/1938 | Waters |
| 2,139,245 | A | * | 12/1938 | Ogden ..... 601/139 |
| 2,148,483 | A | | 2/1939 | Love et al. |
| 2,176,309 | A | | 10/1939 | Love et al. |
| 2,706,825 | A | | 4/1955 | Blakeman ..... 15/176.4 |
| 3,129,449 | A | | 4/1964 | Cyzer ..... 15/28 |

(Continued)

FOREIGN PATENT DOCUMENTS

DE 199 49 671 * 4/2001

(Continued)

*Primary Examiner*—Laura C Guidotti
(74) *Attorney, Agent, or Firm*—Michael J. Wallace Jr.

(57) ABSTRACT

A toothbrush includes a head having a bristle carrying surface formed from a thin resilient flexible dome shaped membrane. An air space is located between the base of the head and the membrane so that the membrane is capable of flexing to alter its original shape during use of the toothbrush and then recover to the original shape randomly during use. In a further practice of the invention the head and/or handle have elastomeric portions at least partially surrounding an open area. These portions are readily deflectable under pressure during use to improve handling of the toothbrush and orientation of the cleaning elements. Alternatively the toothbrush includes a longitudinal hinge collinear with the longitudinal axis of the toothbrush head so as to separate the head into a pair of side by side longitudinal sections, each of which has outwardly extending cleaning elements. The hinge is made of a resilient spring-like material to urge the sections to return to their original position after the hinge has been opened as a result of the cleaning elements contacting the teeth.

11 Claims, 6 Drawing Sheets

U.S. PATENT DOCUMENTS

| | | | | | |
|---|---|---|---|---|---|
| 3,739,419 | A | | 6/1973 | Natman et al. | |
| 3,766,590 | A | * | 10/1973 | Wachtel | 15/186 |
| 4,240,452 | A | | 12/1980 | Jean | |
| 4,500,939 | A | | 2/1985 | Gueret | |
| 4,520,526 | A | | 6/1985 | Peters | |
| 5,146,645 | A | | 9/1992 | Dirksing | |
| 5,228,466 | A | | 7/1993 | Klinkhammer | |
| 5,325,560 | A | | 7/1994 | Pavone et al. | 15/106 |
| 5,390,984 | A | | 2/1995 | Boucherie et al. | 300/21 |
| 5,454,133 | A | | 10/1995 | Garnet | |
| 5,483,722 | A | | 1/1996 | Scheier et al. | 15/167.2 |
| 5,581,840 | A | | 12/1996 | Chen | |
| 5,630,244 | A | | 5/1997 | Chang | 15/167.1 |
| 5,799,354 | A | | 9/1998 | Amir | |
| 5,813,079 | A | | 9/1998 | Halm | 15/167.1 |
| 5,839,149 | A | | 11/1998 | Scheier et al. | |
| 5,946,759 | A | | 9/1999 | Cann | 15/167.1 |
| 5,970,564 | A | | 10/1999 | Inns et al. | 15/201 |
| 5,987,690 | A | | 11/1999 | Heuler | |
| 6,000,083 | A | * | 12/1999 | Blaustein et al. | 15/28 |
| 6,003,189 | A | | 12/1999 | Falleiros | |
| D421,843 | S | | 3/2000 | Joergensen | |
| 6,088,870 | A | | 7/2000 | Hohlbein | 15/167.1 |
| 6,141,817 | A | | 11/2000 | Dawson | |
| 6,290,496 | B1 | * | 9/2001 | Azar et al. | 433/29 |
| 6,360,395 | B2 | * | 3/2002 | Blaustein et al. | 15/28 |
| 6,641,764 | B2 | | 11/2003 | Lanvers | 264/157 |
| 6,779,851 | B2 | * | 8/2004 | Bouchiere | 300/21 |
| 6,938,294 | B2 | * | 9/2005 | Fattori et al. | 15/22.2 |
| 6,988,777 | B2 | * | 1/2006 | Pfenniger et al. | 300/5 |
| 7,036,179 | B1 | * | 5/2006 | Weihrauch | 15/167.1 |
| 2003/0033679 | A1 | * | 2/2003 | Fattori et al. | 15/22.1 |

FOREIGN PATENT DOCUMENTS

| | | |
|---|---|---|
| EP | 454625 | 10/1991 |
| GB | 480845 | 3/1938 |
| GB | 524135 | 7/1940 |
| WO | WO 90/01281 | 2/1990 |

* cited by examiner 210
212
214
216
218
220
222
224
226
228
230
232
234
236
238
240
242
A
15
15

TOOTHBRUSH

This application is a continuation of application PCT/US2003/024878, filed Aug. 8, 2003, which claims the benefit of U.S. Provisional Application 60/402,162 filed Aug. 9, 2002, both of which are incorporated herein by reference in their entirety.

BACKGROUND OF THE INVENTION

The present invention is directed to a manually held and operated toothbrush or to a powered toothbrush which includes a handle and a head. Cleaning elements are mounted to the head such as tufts of bristles. When toothpaste is applied to the cleaning elements the user inserts the head into the mouth and brushes the teeth in a known manner.

The head of a conventional toothbrush usually has a flat or slightly altered surface to which cleaning elements are attached. Usually the cleaning elements are strands of plastic material(s) formed into tufts or other groupings. The strand groupings are attached to the head either before or after forming the toothbrush handle.

Various attempts have been made for providing flexibility to the manner in which the bristles are attached. Various approaches have also been taken wherein the bristle carrying surface of the head is not flat. U.S. Pat. No. 1,688,581, for example, discloses a toothbrush having a bristle carrying member which is ordinarily bowed inwardly into the hollow head. The bristle carrying member can be bowed outwardly by manipulating a wire mounted in the toothbrush.

U.S. Pat. No. 5,483,722 discloses a toothbrush with a resilient flexible bristle support which spans spaced parallel handle extensions. Different embodiments of the toothbrush include having the support bowed inwardly or bowed outwardly.

U.S. Pat. No. 5,325,560 relates to an orthodontic toothbrush which includes various rows of bristles including centrally located longitudinally arranged sets of bristles mounted on a flexible member over an air pocket.

U.S. Pat. No. 5,799,354 discloses a toothbrush of rocker formation wherein base sections are joined together by hinges. The toothbrush also includes a hollow space below the base sections.

U.S. Pat. No. 5,454,133 discloses a toothbrush having a closed system of passageways for a non-compressible medium such as a compressed gas which flows below the bristle carrying base members.

U.S. Pat. No. 6,088,870 discloses a toothbrush head with flexibly mounted bristles by utilizing a flexibly resilient lattice network so that the bristles deflect during brushing to conform to various arcuate surfaces of the teeth.

U.S. Pat. No. 2,003,243 issued May 28, 1935 to Campbell et al. discloses blocks containing groups of bristles that are mounted on a flexible wire attached to a rigid toothbrush head (page 1, column 2, lines 45-55). The flexibility of this mounting wire helps the bristles to conform to the shape of teeth being cleaned.

Blakeman U.S. Pat. No. 2,706,825 issued Apr. 26, 1955 discloses a demountable bristle holder for a toothbrush which flexes up and down relative to the longitudinal axis of the toothbrush body. This flexible member changes position. This plus the pressure of the brush against teeth and movement of the brush permits the brush to contact the teeth at various degrees of conformation (column 2, lines 15-18).

Peters U.S. Pat. No. 4,520,526 issued Jun. 4, 1985 has a flexible section in the handle which permits the head portion to move relative to the handle portion of the toothbrush in one plane. This patent suggests that the flexibility avoids damaging delicate tooth material and gum tissue (column 1, line 42-44). Similar structures for imparting flexibility to the head of a toothbrush and thereby reduce wear on tooth and gum are disclosed in U.S. Pat. No. 5,146,645.

Other approaches to flexible mounting of toothbrush cleaning elements are disclosed in U.S. Pat. Nos. 3,355,546 and 5,839,149. In these patents, the head of the toothbrush is placed under the biting surface of the tooth in a plane perpendicular to the plane of the tooth. The head of the brush when so oriented has short bristles in the middle of the head which are pushed against the biting surface which causes longer outer bristles to rotate into engagement with the side of the teeth and the gum line.

U.S. Pat. No. 5,987,690 issued Nov. 23, 1999 to Heuler discloses a toothbrush with linkages between handle and head that facilitate deflection of the head so that the free bristle ends retain parallel alignment with respect to the handle during use.

U.S. Pat. No. 6,003,189 issued Dec. 21, 1999 discloses a flexible section of a toothbrush between handle and head to absorb part of the force applied by the user of a toothbrush. An elastic shock absorbing means is inserted in this section to bias the head into its inoperative position.

U.S. Pat. No. 6,141,817 discloses a toothbrush head with a central longitudinal axis that underlies the middle of a resilient member containing bristles. The central axis limits deformation of the middle of the resilient member. The balance of the head on either side of the central axis is sloped to allow greater movement of the flexible member, thereby causing outer bristles to splay outward. The outward spraying is believed to improve crevice intrusion of the bristles (column 2, lines 40-46).

European Patent Publication 0 454 625 A1 dated Oct. 30, 1991 discloses a cam in the handle of a tooth-brush that can be used to change the angular orientation of the head relative to the handle.

Other attempts made in the prior art to provide some form of movability of cleaning elements are described in U.S. Pat. No. 5,228,466 and WO 90/01281 which disclose a toothbrush wherein both the handle and head are longitudinally hinged so as to provide displaceable bristles which are straddled about a row of teeth.

U.S. Pat. No. 1,616,484 discloses a toothbrush which is hinged along the length of the handle so that two spaced head sections can be disposed back to back with respect to each other. U.S. Pat. No. 1,616,484 discloses a hinged toothbrush that would provide for brushing a tooth from three different directions. U.S. Pat. Nos. 5,528,782 and 5,269,083 disclose the bristles as being mounted in a rocking manner. U.S. Pat. No. 5,799,354 discloses the utilization of a hollow space to provide for a hinging action. U.S. Pat. No. 1,924,152 discloses a toothbrush having rows of rubber bristles. U.S. Pat. No. 301,644 discloses a toothbrush having rows of bristles mounted in rubber tongues.

U.S. Pat. No. Des. 421,843 illustrates a toothbrush wherein the bristle carrying surfaces appears to be non-planar.

U.S. Pat. No. 4,240,452 discloses an elastic base toothbrush wherein a bristle carrying plate is mounted over rubber tubes.

A number of patents disclose some tooth and/or gum massage devices having non-planar surfaces. For example, British Patent No. 524135 relates to a gum massaging device having an air filled hollow rubber head to provide an air cushion for the gum massaging members. U.S. Pat. No.

1,058,273 discloses a massaging device having an interior air space. U.S. Pat. No. 2,148,483 discloses a tooth and gum massager and exerciser which includes a void filled with air. U.S. Pat. No. 2,176,309 also discloses a gum massager having air pockets.

Hairbrushes are also disclosed in various patents having dome shaped outer surfaces. Examples of these patents include U.S. Pat. Nos. 3,739,419, 4,500,939 and 5,581,840. Similarly U.S. Pat. No. Des. 892,299 shows a toilet brush with a convex shaped bristle carrying surface.

SUMMARY OF THE INVENTION

An object of this invention is to provide a toothbrush head having a dome shaped or a trampoline type cleaning element carrying surface to provide increased flexibility of the cleaning elements.

A further object of this invention is to provide a toothbrush wherein the head is hinged along a hinge axis collinear with the longitudinal axis of the head.

A still further object of this invention is to provide such a toothbrush which utilizes cleaning elements that can wrap around the edge of the teeth for simultaneous contact with both the front and top of the teeth.

A yet further object of this invention is to provide manufacturing techniques for making such a toothbrush.

In accordance with one aspect of this invention a toothbrush includes a head in the form of a base having an upstanding wall to create a peripheral frame. A thin resilient membrane is mounted to the frame with an open space between the membrane and the frame. In its initial condition, when the toothbrush is not being used the membrane is convex so that its original shape is dome-like. The membrane is capable of flexing to alter the original shape during use when the cleaning elements carried by the membrane are brushed against the teeth to recover to the original shape randomly during such use.

Preferably, the cleaning elements are bristles secured to the membrane by in-molded technology.

In a preferred practice of the invention the toothbrush head is oval shaped and the membrane is also oval shaped. The membrane is convex in both its longitudinal and transverse directions.

In accordance with another aspect, this invention provides a simplified and effective way to obtain desired flexibility in head and handle. Like a trampoline, at least the portion of the head carrying bristles is constructed to allow easy deformation of the bristles when in use, which improves contact with, and cleaning of, teeth. Pressure on the bristles against the teeth causes the head to deflect along with the bristles but the flexible head is designed to return to its original position once the pressure on the bristle is relieved. During the transition from heavy pressure to no pressure on the handle, the bristle stays in constant contact with the tooth because of the flexibility built into the toothbrush head.

In accordance with still another aspect of this invention the head of the toothbrush has a spine which extends collinear with the longitudinal axis of the head thereby dividing the head into a pair of side by side longitudinal sections connected to the spine. The spine forms a hinge axis made of resilient material which serves as a spring so as to permit the sections to move from and to an original position in response to contacting the teeth.

In a preferred practice of this aspect of the invention the side by side sections may also include soft flexible material. Preferably, the cleaning elements on each section include an outer set of cleaning elements of longer length than an inner set. The outer cleaning elements could function as plaque removal bristles which are of sufficient length to extend partially along the tooth while the inner cleaning elements brush against the tooth. The terminal surfaces of the inner sets of cleaning elements preferably form an obtuse angle from the two sets of inner cleaning elements of the side by side sections to maximize contact with the teeth when the sections are in their original position. During use the brush head is pressed against the edge of the teeth thus causing the flexible hinge to open and close during cleaning.

THE DRAWINGS

DETAILED DESCRIPTION

Figures 1, 2, 3, 4:
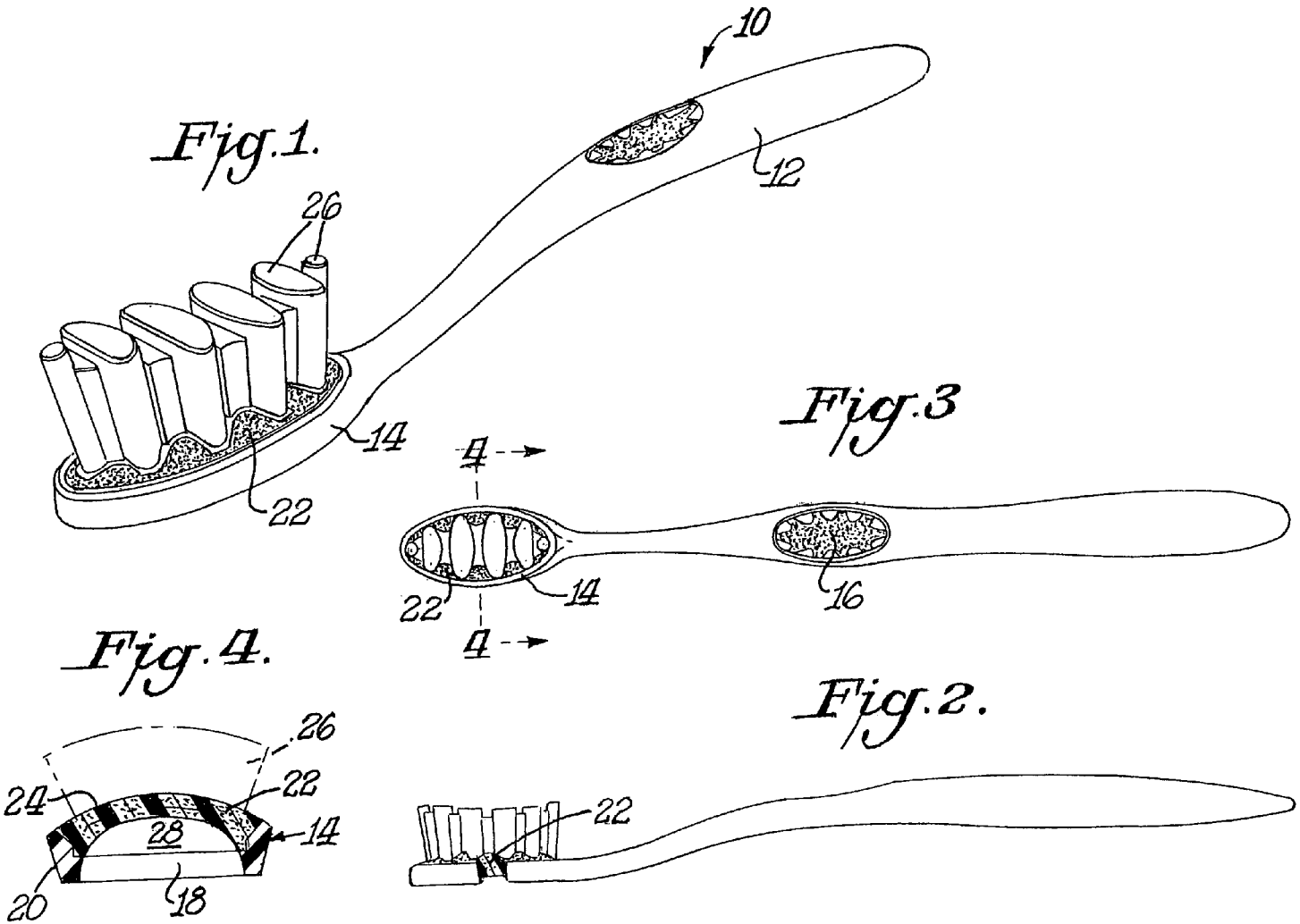
FIG. 1 is a perspective view of a toothbrush in accordance with this invention.
FIG. 2 is a side elevational view of the toothbrush shown in FIG. 1.
FIG. 3 is a front elevational view of the toothbrush shown in FIGS. 1-2.
FIG. 4 is a cross-sectional view taken through FIG. 3 along the line 4-4.

FIGS. 1-4 illustrate a toothbrush 10 in accordance with one embodiment of this invention. As shown therein toothbrush 10 includes a handle 12 and a head 14. Handle 12 may include a suitable grip pad 16 made of an elastomer material. The invention, however, is primarily directed to the structure of head 14. As shown in FIG. 4 head 14 has a base portion 18 with an upstanding wall 20 to create a peripheral frame extending outwardly above base portion 18. In accordance with this invention a membrane 22 is attached to frame 20 completely along its periphery. Membrane 22 in its initial non-use condition is convex or bowed outwardly as best shown in FIG. 4. The convex bowing would be preferably both in the longitudinal and transverse directions thus presenting a dome-like outer surface 24 to which cleaning elements 26 are connected.

Figure 5:
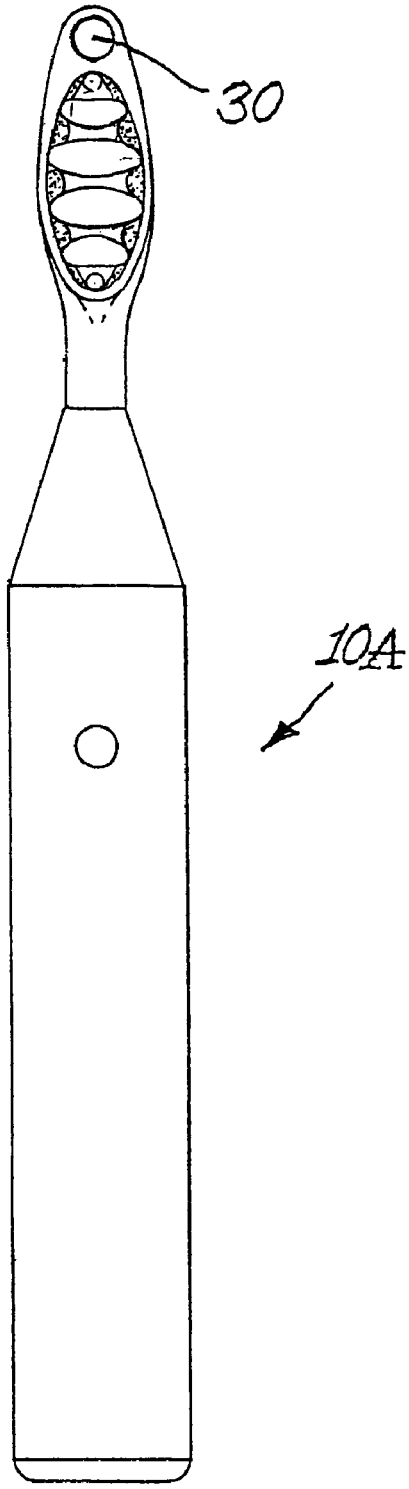
FIG. 5 is a front elevational view of a powered toothbrush in accordance with this invention.

The invention in all embodiments is particularly suitable for cleaning elements in the form of strands or bristles attached via in-molded technology (IMT) methods that generally require small cross-sections of material into which the strands are permanently attached. The strands utilizing IMT methods are preferably attached during formation of the toothbrush handle or at least during formation of the head which is the portion of the toothbrush to which the strands and other materials are attached. A key feature of the invention of FIGS. 1-4 and of FIG. 5 is the use of thin cross-sections of material for membrane 22. Membrane 22 is flexible and resilient. The cross-section shown, for example, in FIG. 4 is formed like a moon crescent thus representing a shape similar to the dome.

Because of the open space 28 between base portion 18 and membrane 22 the membrane would move from its original dome-like shape to be distorted into other shapes as the cleaning elements or bristles 26 contact the teeth. Thus, the dome 22 has a thin membrane of material or combinations of material that can flex to become altered from its original shape and recover to its original shape randomly during brushing. The bristles 26 are attached to the flexible dome and move accordingly, creating a random topology and by doing so improve the cleaning of the teeth. The moving bristle strands have more degrees of motion than other toothbrushes and thus represent a different and unique tooth brushing device.

In the illustrated embodiment of this invention the head 14 is generally oval shape and the membrane 22 has a corresponding oval shape. See FIG. 3.

Any suitable form of cleaning elements may be used as the cleaning elements 26 in the broad practice of this invention. The term "cleaning elements" is intended to be used in a generic sense which could include conventional fiber bristles or massage elements or other forms of cleaning elements such as elastomeric fingers or walls arranged in a circular cross-sectional shape or any type of desired shape including straight portions or sinusoidal portions. Where bristles are used, the bristles could be mounted to tuft blocks or sections by extending through suitable openings in the tuft blocks so that the base of the bristles is mounted within or below the tuft block and below membrane 22.

It is to be understood that the specific illustration of the cleaning elements is merely for exemplary purposes. The invention can be practiced with various combinations of the same or different cleaning element configurations (such as stapled or in-molded technology bristles, anchor free technology (AFT), etc.) and/or with the same bristle or cleaning element materials (such as nylon bristles, spiral bristles, rubber bristles, etc.) Similarly, while FIG. 2 illustrates the cleaning elements to be generally perpendicular to the outer surface 24 membrane 22 or head 14 some or all of the cleaning elements may be angled at various angles with respect to the outer surface of head 14. It is thereby possible to select the combination of cleaning element configurations, materials and orientations to achieve specific intended results to deliver additional oral health benefits, like enhanced cleaning tooth polishing, tooth whitening and/or massaging of the gums.

Preferably, however, cleaning elements 26 are IMT bristles since IMT bristles require small cross-sections of material into which the strands are attached and the membrane 22 in the preferred practice of the invention has a small cross-section.

Although FIGS. 1-3 illustrate the membrane 22 to occupy generally the entire head 14, the invention may be practiced where the head 14 is of sufficient size that it could include other bristle carrying surfaces adjacent to the dome shape membrane 22.

Although FIGS. 1-4 illustrate a manually operated toothbrush, the invention may also be practiced where the head includes one or more power or electrically operated movable sections carrying cleaning elements. Such movable section may oscillate in a rotational manner or may oscillate linearly in a longitudinal direction with respect to the longitudinal axis of the head or may oscillate linearly in a lateral or transverse direction with respect to the longitudinal axis of the head. The movable section may oscillate in and out in a direction toward and away from the outer surface of the head. The movable section may rock back and forth with respect to the outer surface of the head. The movable section may rotate continuously in the same direction, rather than oscillate. Any suitable drive mechanism may be used for imparting the desired motion to the movable section. Where plural movable sections are used, all of the movable sections may have the same type and direction of movement, or combinations of different movements may be used.

FIG. 5 illustrates a toothbrush 10A which includes a power driven movable disc or section 30 having cleaning elements. The movable section 30 could be oscillated rotationally such as by using the type of drive mechanism shown in U.S. Pat. No. 5,625,916, or could move in and out using the type of drive mechanism shown in U.S. Pat. No. Re 35,941, all of the details of both patents are incorporated herein by reference thereto. Alternatively, the other types of drives referred to above could move section 30 in other manners and directions. Although FIG. 5 shows movable section 30 to be at the distal end of the head, the movable section(s) could be located at any desired location on the head.

Handle 12, base 18 and frame 20 are preferably made of hard plastic materials which are used for manual toothbrushes. As noted, however, a characteristic of dome shape membrane 22 is that it is made of a flexible resilient material such as an elastomer capable of being moved from its original position and then returning to that original position.

Membrane 22 may be secured to frame 20 in any suitable manner. Thus, for example, frame 20 includes inwardly inclined surfaces for receiving membrane 22. Other structural arrangements may be used within the practice of this invention to mount membrane 22 on head 14.

Figure 9:
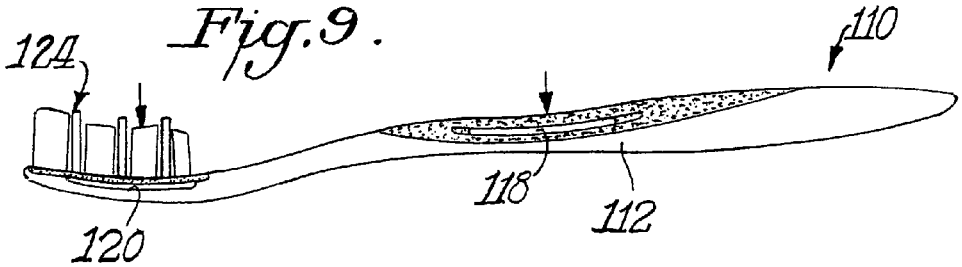
FIG. 9 is a side elevational view of the toothbrush of FIG. 6 showing deflection in the open area under the bristles and the handle area.

FIGS. 6-9 illustrate a manual toothbrush 10 in accordance with another embodiment of this invention. This is a variation of the prior embodiment using a trampoline type structure to achieve an up and down motion. As shown therein toothbrush 110 includes a handle 112 and a head 114. Handle 112 may include a suitable area 116 made of an elastomeric material. This elastomeric portion of the handle is preferably molded with an open area 118 which is readily deformable by the user. The elastomeric material 16 on the top side of the handle 12 (as viewed in FIGS. 6, 7 and 9) will yield under pressure of the user's fingers to provide a better grip on the handle while providing a more comfortable feel to the handle. FIG. 9 illustrates this elastomeric portion 116 of the handle 112 in a depressed state. The downward arrow in this Figure represents the pressure applied by the toothbrush user. The open area 118 is thereby minimized. As soon as the user's pressure is released, the properties of the elastomeric portion 116 of the handle 112 return the elastomeric material 116 to its original shape illustrated in FIG. 6.

A similar flexible, deformable open area 120 is created in the head by inclusion of an elastomeric portion 122 in the head overlying open area 120. Cleaning elements 124 are arrayed in the elastomeric portion of the head and fastened thereto by known methods including in-molded technology (IMT). Bristle attachment utilizing IMT methods preferably occurs during formation of the toothbrush handle or at least during formation of the elastomeric portion 122 of the head 114.

In use, the application of pressure by the toothbrush user causes a like pressure of the teeth against cleaning elements 124 as illustrated by the arrow in FIG. 9. This causes deflection of the elastomeric portion 122 of head 114 which in turn causes a reorientation of cleaning elements relative to the teeth being cleaned. As the user's pressure is reduced, the open area 120 of head 114 opens up causing the cleaning elements to follow the shape of the teeth being brushed and thereby improving the cleaning of the teeth. When all user pressure is released, the open area 120 returns to its original shape.

The elastomeric portion 122 of head 114 should be a material or combinations of material that can flex to become altered from its original shape and recover to its original shape randomly during brushing. The cleaning elements, for example, bristles, are attached to the flexible membrane creating a flexible orientation of cleaning elements 124 which improves the cleaning of the teeth. The moving bristle strands have considerable degrees of motion and thus provide a unique tooth brushing experience.

Figure 7:
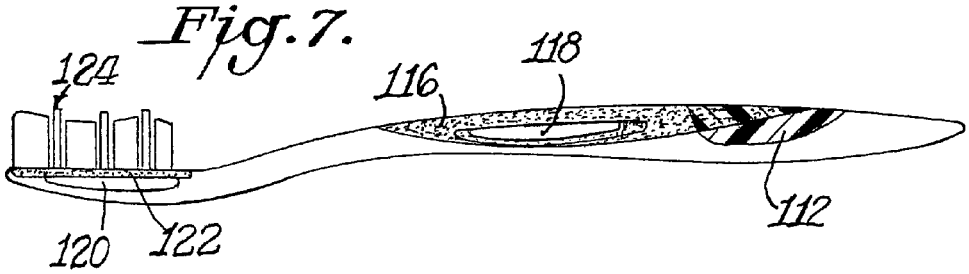
FIG. 7 is a side elevational view of the toothbrush shown in FIG. 6.

Any suitable form of cleaning elements may be used as the cleaning elements 124 in the broad practice of this invention, as discussed with the embodiments of FIGS. 1-5. It is to be understood that the specific illustration of the cleaning elements is merely for exemplary purposes. The invention can be practiced with various combinations of the same or different cleaning element configurations (such as stapled or in-molded technology bristles, AFT, etc.) and/or with the same bristle or cleaning element materials (such as nylon bristles, spiral bristles, rubber bristles, etc.) Similarly, while FIGS. 7 and 9 illustrates the cleaning elements to be generally perpendicular to the elastomeric portion 122 of head 114, some or all of the cleaning elements may be angled at various angles. It is thereby possible to select the combination of cleaning element configurations, materials and orientations to achieve specific intended results to deliver additional oral health benefits, like enhanced cleaning, tooth polishing, tooth whitening and/or massaging of the gums.

Portions of handle 112 and head 114, may be made of hard plastic material which is used for manual toothbrushes. As noted, however, a feature of this toothbrush is use of elastomeric portions 116 of the handle and/or elastomeric portion 122 of head 114, such as an elastomer capable of being moved from its original position and then returning to its original position.

This invention may also be practiced where the head 114 includes one or more power or electrically operated movable sections carrying cleaning elements.

Figure 10:
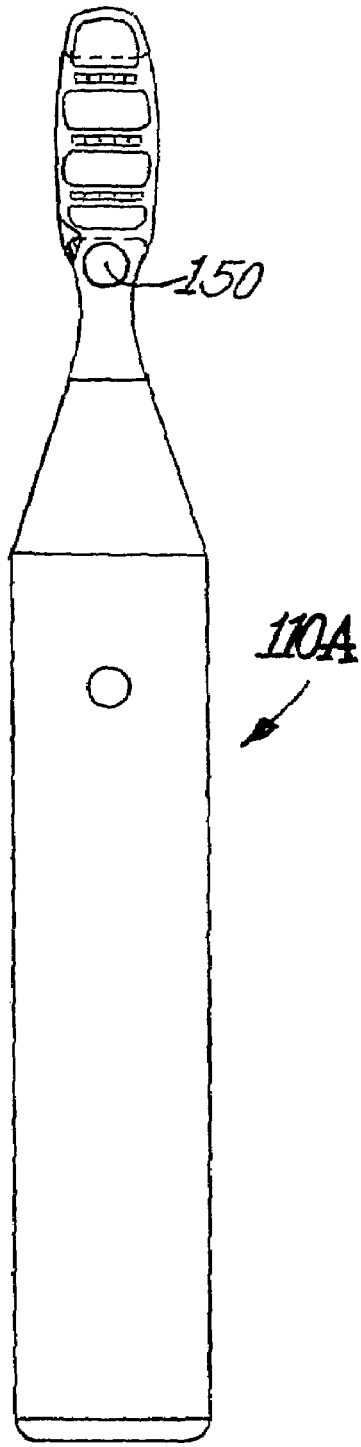
FIG. 10 is a top plan view of a powered toothbrush in accordance with the embodiment of FIGS. 6-9 of this invention.

FIG. 10 illustrates a toothbrush 110A which includes a power driven movable disc or section 150 having cleaning elements. The movable section 150 could be similar to section 30 of FIG. 5. Although FIG. 10 shows movable section 150 to be at the one end of the head, as with FIG. 5, the movable section(s) could be located at any desired location on the head.

Figures 11, 12, 13, 14, 15:
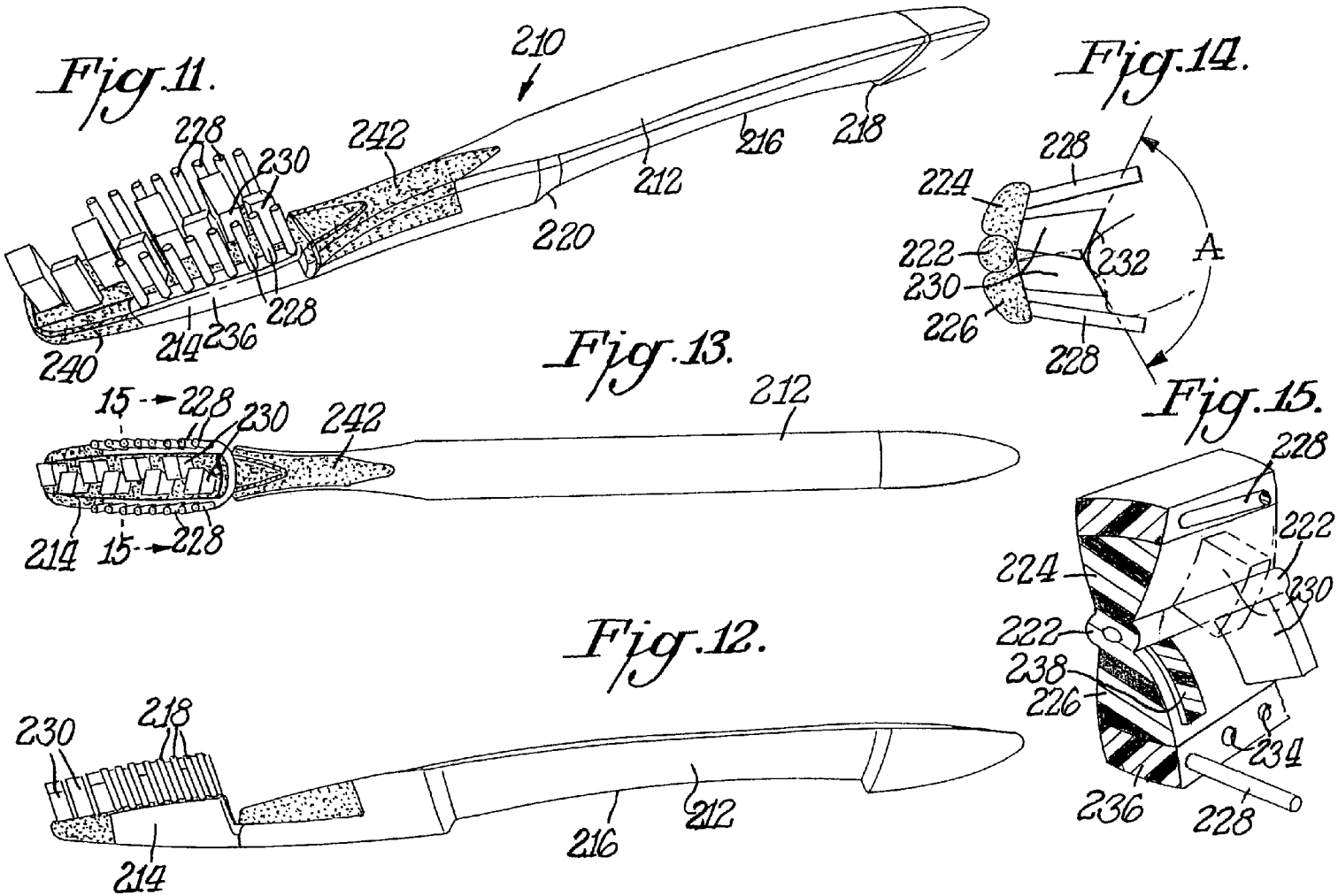
FIG. 11 is a perspective view of a toothbrush formed in accordance with still another embodiment of this invention.
FIG. 12 is a side elevational view of the toothbrush shown in FIG. 11.
FIG. 13 is a top plan view of the toothbrush shown in FIGS. 11-12.
FIG. 14 is an end elevational view of the toothbrush shown in FIGS. 11-13 in its original closed position.
FIG. 15 is a cross-sectional view taken through FIG. 13 along the line 15-15, but with the brush head in its hinged open position and omitting some of the cleaning elements.
Figure 16:
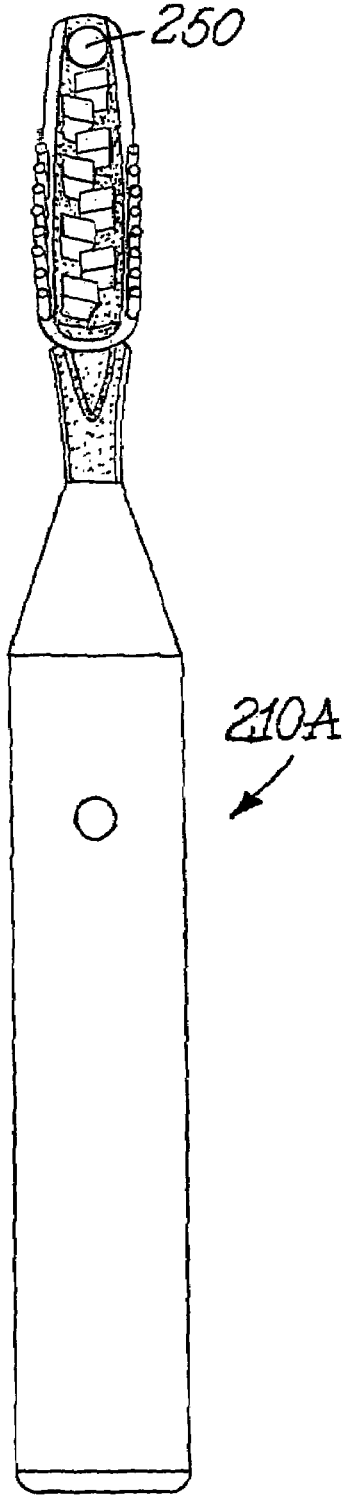
FIG. 16 is a front elevational view of a powered toothbrush in accordance with the embodiment of FIGS. 11-15 of this invention.

In another embodiment of this invention a toothbrush includes a head longitudinally separated into side by side areas by means of a flexible hinge structure that serves as a spring to return the brush head materials and cleaning areas to their original position. FIGS. 11-13 illustrate a toothbrush 210 which includes an elongated handle 212 and a head 214. A portion of handle 212 may be recessed at gripping area 216 between shoulders 218 and 220. Shoulder 218 could extend outwardly a sufficient distance to act as a hook or ledge to facilitate hanging the toothbrush in an inverted condition.

Head 214 and handle 212 are elongated and have a longitudinal axis. As shown in FIGS. 14 and 15 head 214 includes a spine 222 which extends collinear with the longitudinal or major axis of the toothbrush handle and head. As a result, head 214 is separated into two side by side longitudinal sections 224,226 connected to the spine 222. Spine 222 is made of a resilient material such as an elastomer which is sufficiently flexible as to be movable and yet return to its original position. As a result, spine 222 functions as a hinge axis whereby the side by side sections 224,226 may move or pivot about the spine away from the original position shown in FIG. 14 to an open position such as shown in FIG. 15 when the cleaning elements on the sections 224,226 contact the teeth. Then sections 224,226 return to their original position under the influence of the resilient hinge or spine 222. Preferably hinge or spine 222 is confined to head 214.

As illustrated, each of the sections 224,226 includes sets of cleaning elements. For example, an outer set of cleaning elements 228 is located at the outer periphery of each section 224,226 while an inner set of cleaning elements 230 is located closer to the spine 222. Preferably, the terminal surfaces 232 of the inner cleaning elements 230 are tapered toward the hinge axis 222 so that the adjacent terminal ends 232 of each inner set of cleaning elements forms an obtuse angle as indicated by the letter A in FIG. 14 when the brush head is in its original position.

The outer sets of cleaning elements 228 extend outwardly a longer distance from the outer surface of the sections than do the inner cleaning elements 230. As a result, the combined cleaning elements are designed to wrap around the edge of the teeth for simultaneous possible contact with both the front and top of the teeth. See FIG. 14. During use the brush head is pressed against the edge of the teeth causing the flexible hinge to open and close during cleaning.

As illustrated in FIGS. 11-13 in a preferred practice of the invention the outer sets of cleaning elements 228 are bristle bundles of plaque bristles. The inner sets of cleaning elements 230 may be bristles formed by in-molded technology (IMT) where sets of bristles are fused together at one end and the fused end is inserted in a mold cavity during the manufacture of the head.

FIG. 15 shows the sections 224,226 in their open position. FIG. 15 omits some of the cleaning elements so as to provide a better understanding of how the cleaning elements are mounted. As shown therein, the plaque bristles 228 are in the form of bristle bundles or tufts inserted into individual holes 234 in bristle container 236. The inner sets of cleaning elements 230 are IMT bristles mounted in IMT container 238. The IMT containers 238 may be made of soft flexible elastomer material integral with hinge axis 222, as shown in FIG. 15.

As shown in FIGS. 11-13 the bristle container 236 does not extend completely to the distal end of the head 214. Accordingly, side plates 240 are provided on each side of the head longitudinally abutting against bristle containers 236 and disposed against containers 238 for the remaining length of containers 238 so that a smooth contour results along the side of the head 214. Side plates 240 may also be made of a soft, flexible elastomer material.

As best shown in FIGS. 11-12 each inner row of IMT bristles 230 has its bristles spaced apart or staggered so that the inclined IMT bristles of each section may fit between the spacing of adjacent IMT bristles of the other section.

Although FIGS. 11-15 illustrate a preferred form of cleaning elements to be the plaque bristles and IMT bristles any suitable form of cleaning elements may be used as the cleaning elements 228 and 230 as previously described. Thus the term "cleaning elements" is intended to be used in a generic sense which could include conventional fiber bristles or massage elements or other forms of cleaning elements such as elastomeric fingers or walls arranged in a circular cross-sectional shape or any type of desired shape including straight portions or sinusoidal portions. Where bristles are used, the bristles could be mounted to tuft blocks or sections by extending through suitable openings in the tuft blocks so that the base of the bristles is mounted within or below the tuft block.

Similarly, it is to be understood that the specific illustration of the cleaning elements is merely for exemplary purposes. The invention can be practiced with various combinations of the same or different cleaning element configurations (such as stapled or IMT bristles, AFT, etc.) and/or with the same bristle or cleaning element materials (such as nylon bristles, spiral bristles, rubber bristles, etc.) Similarly, while FIG. 12 illustrates the cleaning elements to be generally perpendicular to the outer surface of head 214 some or all of the cleaning elements may be angled at various angles with respect to the outer surface of head 214. It is thereby possible to select the combination of cleaning element configurations, materials and orientations to achieve specific intended results to deliver additional oral health benefits, like enhanced cleaning tooth polishing, tooth whitening and/or massaging of the gums.

Handle 212 could be made of a conventional hard plastic material which could, however, include a soft elastomer section 242 near the head 214. Bristle containers 236,236 could also be made of a hard plastic material while side plates 240 and IMT containers 238 are made of a soft elastomer material. By having the bristle containers 236 mounted against the IMT containers 238, the bristle containers 236 and their cleaning elements 228 move along with the movement of the IMT containers 238 in response to the IMT bristles 230 contacting the teeth. If desired, the bristle containers 236 may also be made of a soft elastomer material.

Figure 6:
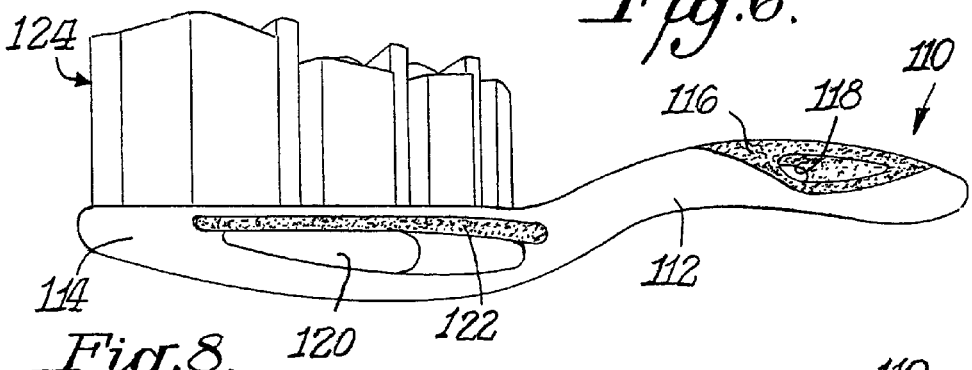
FIG. 6 is a perspective view of a toothbrush having elastic areas in the head and handle to allow deflection of the brush, bristles and handle for better teeth cleaning and control in accordance with a further embodiment of this invention.
Figure 8:
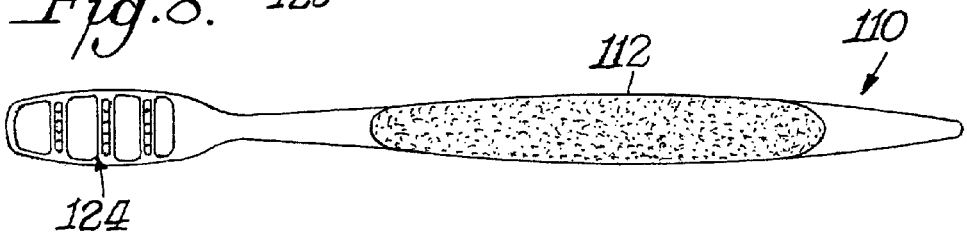
FIG. 8 is a top plan view of the toothbrush shown in FIGS. 6-7.

Although FIGS. 11-13 illustrate a manually operated toothbrush, the invention may also be practiced where the head includes one or more power or electrically operated movable sections carrying cleaning elements. FIG. 6 illustrates a toothbrush 210 which includes a power driven movable disc or section 250 having cleaning elements, similar to the movable sections of toothbrushes 10A and 110A.

What is claimed is:

1. A toothbrush comprising a handle, a head secured to said handle and dimensioned for use in the oral cavity, said head being in the form of a base having an upstanding wall to create a peripheral frame around an outer edge of said head, a thin resilient membrane being an elastomeric material, the membrane having a circumferential periphery conforming to a shape of the peripheral frame, the membrane being mounted directly to said frame by affixing the circumferential periphery of the membrane to said frame to create an interior cavity between said membrane and said base and said wall, the wall having a mounting surface for receiving and securing the circumferential periphery of the membrane to an interior portion of the frame and for enclosing the cavity within the head, said membrane having an initial condition of non-use, said membrane in said initial condition being convex to have an original dome-like shape, at least one tooth cleaning element on said membrane extending away from the head, and said membrane being capable of flexing to alter said original shape during use of said toothbrush and then recovering to said original shape randomly during use of said toothbrush; wherein a section of the head of the toothbrush includes powered cleaning elements and the powered cleaning elements are disposed at the tip end of the head and the membrane is disposed proximate to the handle.

2. The toothbrush of claim 1 wherein said at least one tooth cleaning element comprises bristles secured to said membrane by inmolded technology.

3. The toothbrush of claim 1 wherein said head is oval shaped, and said membrane is oval shaped.

4. The toothbrush of claim 3 wherein said membrane is convex in both its transverse and longitudinal directions.

5. The toothbrush of claim 1, wherein the mounting surface of the wall is inwardly inclined.

6. The toothbrush of claim 1, further including a plurality of elastomeric tooth cleaning elements attached to the membrane.

7. A toothbrush comprising a handle, a head secured to said handle and dimensioned for use in the oral cavity, the head comprising a base and an upstanding wall creating a peripheral frame around an outer edge of the head, a membrane being an elastomeric material, the membrane having a circumferential periphery conforming to a shape of the peripheral frame, the membrane being mounted to said frame by affixing the circumferential periphery of the membrane to said frame to create an enclosed interior cavity in the head, the wall having a mounting surface facing the interior of the cavity, the mounting surface extending from the base to a distal edge of the wall, the mounting surface having a lower vertical portion connected to an inclined portion being adjacent to the distal edge, the membrane being mounted to the vertical portion and the inclined portion, the membrane having an initial condition of non-use, the membrane in the initial condition being convex to have an original dome-like shape, at least one tooth cleaning element being bristles disposed on the membrane extending away from the head, and the membrane being capable of flexing to alter the original shape during use of the toothbrush and then recovering to the original shape randomly during use of the toothbrush; and including powered cleaning elements disposed at a distal end of the head and wherein the membrane is disposed proximate to the handle.

8. The toothbrush of claim 7 wherein said head is oval shaped, and said membrane is oval shaped.

9. The toothbrush of claim 7 wherein said membrane is convex in both its transverse and longitudinal directions.

10. The toothbrush of claim 7, further including a plurality of elastomeric tooth cleaning elements attached to the membrane.

11. The toothbrush of claim 7, wherein a thickness of the membrane at the mounting surface is greater than a thickness of the membrane near a middle portion of the membrane.

* * * * *